US006524394B2

(12) United States Patent
Okazawa et al.

(10) Patent No.: US 6,524,394 B2
(45) Date of Patent: Feb. 25, 2003

(54) DRY ICE CLEANING METHOD AND DRY ICE CLEANING APPARATUS

(75) Inventors: Masaki Okazawa, Kanagawa (JP); Hideo Iwama, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/995,732

(22) Filed: Nov. 29, 2001

(65) Prior Publication Data

US 2002/0068510 A1 Jun. 6, 2002

(30) Foreign Application Priority Data

Dec. 5, 2000 (JP) ..... 2000-370132

(51) Int. Cl.[7] ..... B08B 7/00

(52) U.S. Cl. ..... 134/7; 134/2; 134/6; 134/8; 134/18; 134/34; 134/902; 451/2; 451/38; 451/39; 451/75; 451/89; 451/102

(58) Field of Search ..... 451/2, 39, 38, 451/75, 102, 89; 134/6, 2, 7, 8, 18, 34, 902

(56) References Cited

U.S. PATENT DOCUMENTS

| | | | | | |
|---|---|---|---|---|---|
| 4,038,786 A | | 8/1977 | Fong | 51/320 |
| 5,009,240 A | * | 4/1991 | Levi | 134/198 |
| 5,025,597 A | * | 6/1991 | Tada et al. | 451/39 |
| 5,125,979 A | * | 6/1992 | Swain et al. | 134/7 |
| 5,228,894 A | | 7/1993 | Sato, et al. | 65/102 |
| 5,367,838 A | * | 11/1994 | Visaisouk et al. | 134/7 |
| 5,390,450 A | * | 2/1995 | Goenka | 451/102 |
| 5,846,338 A | * | 12/1998 | Bonora et al. | 134/11 |
| 5,853,128 A | * | 12/1998 | Bowen et al. | 239/329 |
| 6,174,225 B1 | * | 1/2001 | Becker | 451/75 |

FOREIGN PATENT DOCUMENTS

| | | |
|---|---|---|
| JP | 51-60095 | 5/1976 |
| JP | 61-15749 | 1/1986 |
| JP | 10-202208 | 8/1998 |
| JP | 10-202210 | 8/1998 |
| JP | 10-319634 | * 12/1998 |

* cited by examiner

*Primary Examiner*—Sharidan Carrillo
(74) *Attorney, Agent, or Firm*—Fitzpatrick, Cella, Harper & Scinto

(57) ABSTRACT

The present invention provides a cleaning method in accordance with a degree of soiling and a type of contaminant on a surface to be cleaned of a cleaning target. In the method of cleaning a cleaning target, such as an electrical component, with dry ice, during a process of blasting the dry ice toward the surface to be cleaned from a location where the dry ice is stored, a size of the dry ice is adjusted, so cleaning is performed while a cleaning performance of the dry ice is changed in accordance with the type of soiling or contaminant on the surface to be cleaned.

3 Claims, 4 Drawing Sheets

DRY ICE CLEANING METHOD AND DRY ICE CLEANING APPARATUS

FIELD OF THE INVENTION

The present invention relates to a technique for cleaning a surface to be cleaned of a cleaning target by blasting it with dry ice.

Furthermore, the present invention relates to a dry ice cleaning method and apparatus for cleaning a surface to be cleaned of a cleaning target by blasting it with dry ice.

More particularly, the present invention relates to a cleaning method and apparatus using dry ice, which are suitable for cleaning constituent elements and units of a business machine, electric appliance, and the like.

BACKGROUND OF THE INVENTION

A technique causing dry ice particles, as a cleaning agent, to impinge on a surface to be cleaned, thereby removing a substance attached to the surface to be cleaned, is disclosed in, e.g., Japanese Patent Application Laid-Open No. 61-15749.

Japanese Patent Application Laid-Open 10-202210 discloses a cleaning system for automatically carrying out the cleaning operation of a recycling component while preventing it from being damaged.

The technique shown in this reference discloses a system for removing soil of a recycling component of an office automation apparatus by blasting it with granular dry ice. This technique has a cleaning nozzle which injects granular dry ice together with pressurized air, and a system which carries out cleaning operation while moving the cleaning nozzle along the surface of the recycling component.

Japanese Patent Application Laid-Open No. 10-202208 discloses a system performs a cleaning operation by using dry ice pellets as a medium.

Japanese Patent Application Laid-Open No. 51-60095 discloses a technique with a sand blast method using a sublimitation material.

A need for reusing or so-called recycling the constituent components and units of a business machine and electrical appliance has become strong in terms of effective utilization of resources, countermeasure for environmental pollution, and the like.

To recycle the constituent components and units of the above machine and appliance, they must be removed from the machine and appliance, and whether they function correctly must be checked. Also, these components and units must be maintained in or restored to an almost brand-new state.

In practice, such machine and appliance have been soiled or contaminated in the atmosphere where they have been used, and cleaning operation is needed to remove their soil and contamination.

For example, regarding a copying machine or printer as an example of a business machine, as it uses toner as the image forming material, soil or contamination due to toner dust occurs in, e.g., the fixing unit and components and units around it.

Regarding electric home appliances such as a television, air conditioner, refrigerator, cooler, and the like, regulations for recycling have been put into operation. A recycling system is also needed for the components and units of other electrical and electronic devices, business machines, data communication devices, and industrial machines in terms of the environmental and resource problems.

To recycle the components and units incorporated in these machines and devices, countermeasures such as cleaning methods and apparatuses are required for each specific environment where such machine and device are used and for each contamination source.

Some soil and contamination of the cleaning target cannot be removed by a conventional dry ice cleaning apparatus, depending on the degree of soil, the types of contaminants, and the like.

More specifically, as described above, the recycle target has been widening fast to cover home appliances, information devices, and business machines, and the number of the types of devices that use an electrical element and circuit board has increased. This, together with the variety of the environments where these devices and machines are used, leads to an increase in the degree of soil and types of contaminants as the cleaning target. Conventional dry ice cleaning cannot cope with this situation.

On the circuit board, the terminals of elements constituting an electrical and electronic circuit, pin terminals for electrical connections, and the like are disposed. These components should not be deformed by an impact.

SUMMARY OF THE INVENTION

The present invention has been made in view of the problems described above, and has as its object to improve the cleaning effect in accordance with the degree of soil and the types of contaminants of a surface to be cleaned of a cleaning target.

In order to solve the above problems, according to the present invention, there is provided a method of cleaning a cleaning target, including an electrical component, with dry ice, wherein during a process of blasting dry ice toward a surface to be cleaned from a location where the dry ice is stored, a size of the dry ice is adjusted, so cleaning is performed while the size of the dry ice is changed in accordance with a type of soil or contaminant of the surface to be cleaned.

Furthermore, according to the present invention, there is provided an apparatus for cleaning a cleaning target, including an electrical component, with dry ice, comprising means for changing a size of the dry ice in accordance with a type of soil and contaminant of the cleaning target.

Furthermore, according to an aspect of the present invention, there is provided a method of cleaning a cleaning target, including an electrical component, with dry ice, wherein cleaning is performed while a cleaning performance obtained by blasting the dry ice is adjusted in accordance with a contamination degree and type of contaminant of a surface to be cleaned of the cleaning target.

The cleaning performance is adjusted by changing the size of the dry ice.

The cleaning performance is adjusted by adjusting a blast shot velocity of the dry ice toward the surface to be cleaned.

Other objects and advantages besides those discussed above shall be apparent to those skilled in the art from the description of a preferred embodiment of the invention which follows. In the description, reference is made to accompanying drawings, which form a part hereof, and which illustrate an example of the invention. Such example, however, is not exhaustive of the various embodiments of the invention, and therefore reference is made to the claims which follow the description for determining the scope of the invention.

DETAILED DESCRIPTION OF THE PREFERRED EMBODIMENT

The embodiment of the present invention will be described with reference to the accompanying drawings.

Figure 1:
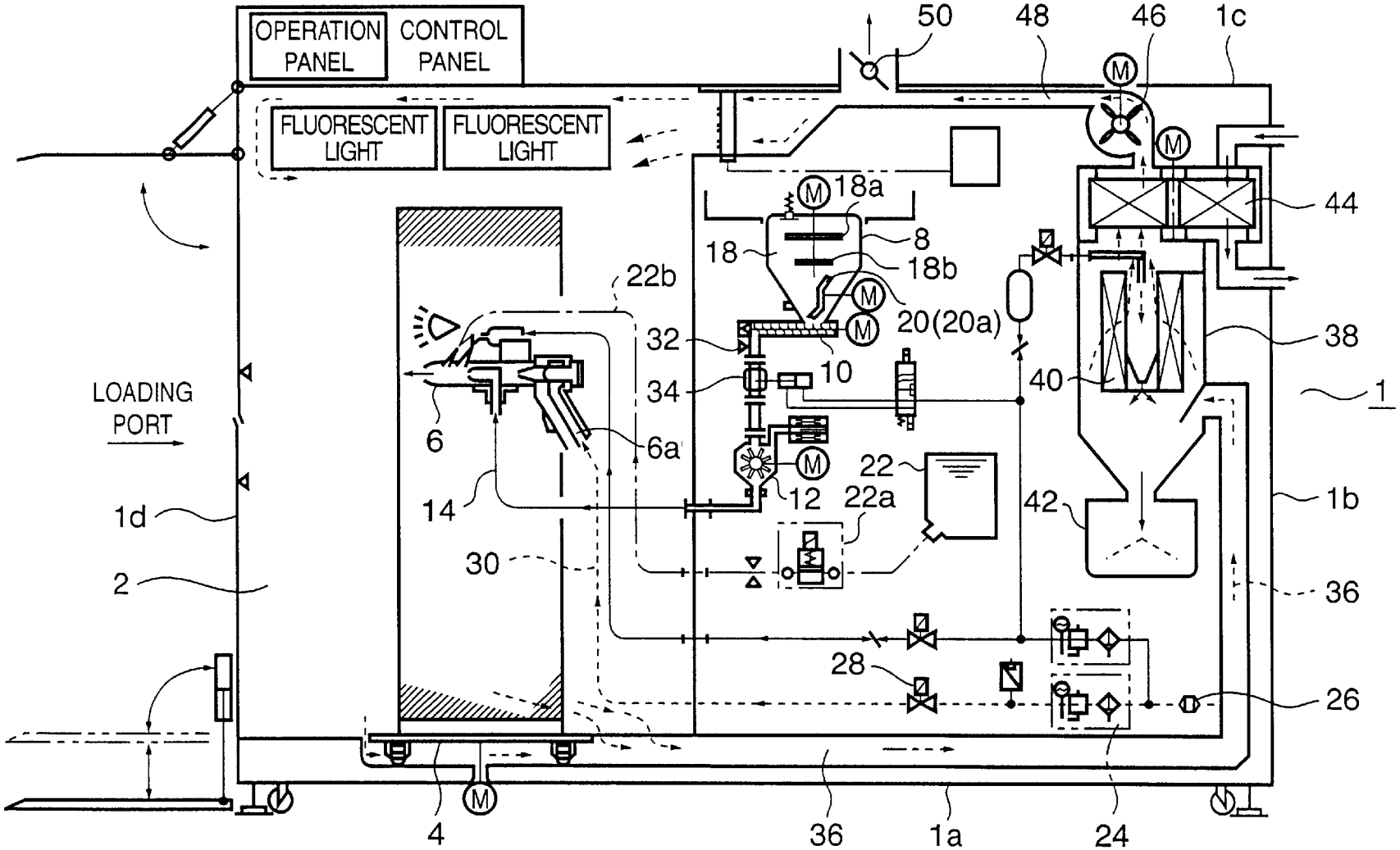
FIG. 1 is a view for explaining the arrangement of a cleaning apparatus according to the present invention.

FIG. 1 is a view showing the arrangement of the main part of a dry ice cleaning apparatus that practices the present invention. Referring to FIG. 1, reference numeral 1 denotes the housing of the apparatus body. The housing 1 is constituted by a base 1*a*, outer wall 1*b*, ceiling 1*c*, opening 1*d*, and the like.

Reference numeral 2 denotes a cleaning booth set in the housing 1. A rotary table 4 is set in the cleaning booth 2, and a cleaning target is placed on the rotary table 4.

Reference numeral 6 denotes a blast nozzle arranged in the cleaning booth 2 to blast dry ice.

Reference numeral 8 denotes a hopper 8 for storing dry ice. A device 10 for supplying a predetermined amount of dry ice is arranged at the lower opening of the hopper 8.

The supply device 10 is constituted by a spiral gear rotatably driven by a motor, a cylinder for rotatably storing the spiral gear, and the like.

Reference numeral 12 denotes a dry ice crushing device connected to the dry ice supply device 10. The dry ice crushing device 12 is constituted by a crushing rotary blade, rotary motor, and the like.

The crushing device 12 is connected to the dry ice supply port of the dry ice blast nozzle 6 through a connection pipe 14.

Reference numeral 18 denotes a first agitation device. The first agitation device 18 is constituted by first propellers 18*a* and 18*b* mounted on a shaft parallel to the direction of gravity in a hopper cylinder, and a motor for rotatably driving the propellers 18*a* and 18*b*.

Reference numeral 20 denotes a second agitation device. The second agitation device 20 is constituted by a second propeller 20*a* rotatable in a direction parallel to a direction perpendicular to the direction of gravity, and a motor for rotatably driving the second propeller 20*a*.

Reference numeral 22 denotes a container for storing a surfactant as the detergent. The container 22 is connected to the blast port of the dry ice blast nozzle 6 through a flow rate regulation pump 22*a* and supply pipe 22*b*.

Reference numeral 24 denotes a blast air adjustment device. The blast air adjustment device 24 adjusts pressurized air supplied from an air supply pipe 26 to a predetermined pressure and supplies it to an air supply port 6a of the blast nozzle through a valve 28 and pipe 30.

Reference numeral 32 denotes a sensor that forms a supply amount detection device for detecting the amount of dry ice supplied from the dry ice supply device 10. The sensor 32 is formed on a supply pipe connected to the supply device 10.

Reference numeral 34 denotes a regulating valve for constituting a supply amount regulation device.

Reference numeral 36 denotes a recovery pipe for recovering dry ice containing the detergent that has cleaned the cleaning target. The recovery pipe 36 is connected to a dust collection device 38.

Reference numeral 40 denotes a dust collection filter arranged in the dust collection device 38; 42, a dust tank; and 44, a recovery device for recovering carbon dioxide ($CO_2$) of dry ice.

Reference numeral 46 denotes an exhaust blower; 48, an exhaust pipe; and 50, an exhaust regulation damper.

Reference numeral 52 denotes a device for changing the size of dry ice. The device 52 controls the rotational speed of the motor which rotatably drives the rotary blade of the dry ice crushing device 12.

(Explanation of Cleaning Target)

Figure 2:
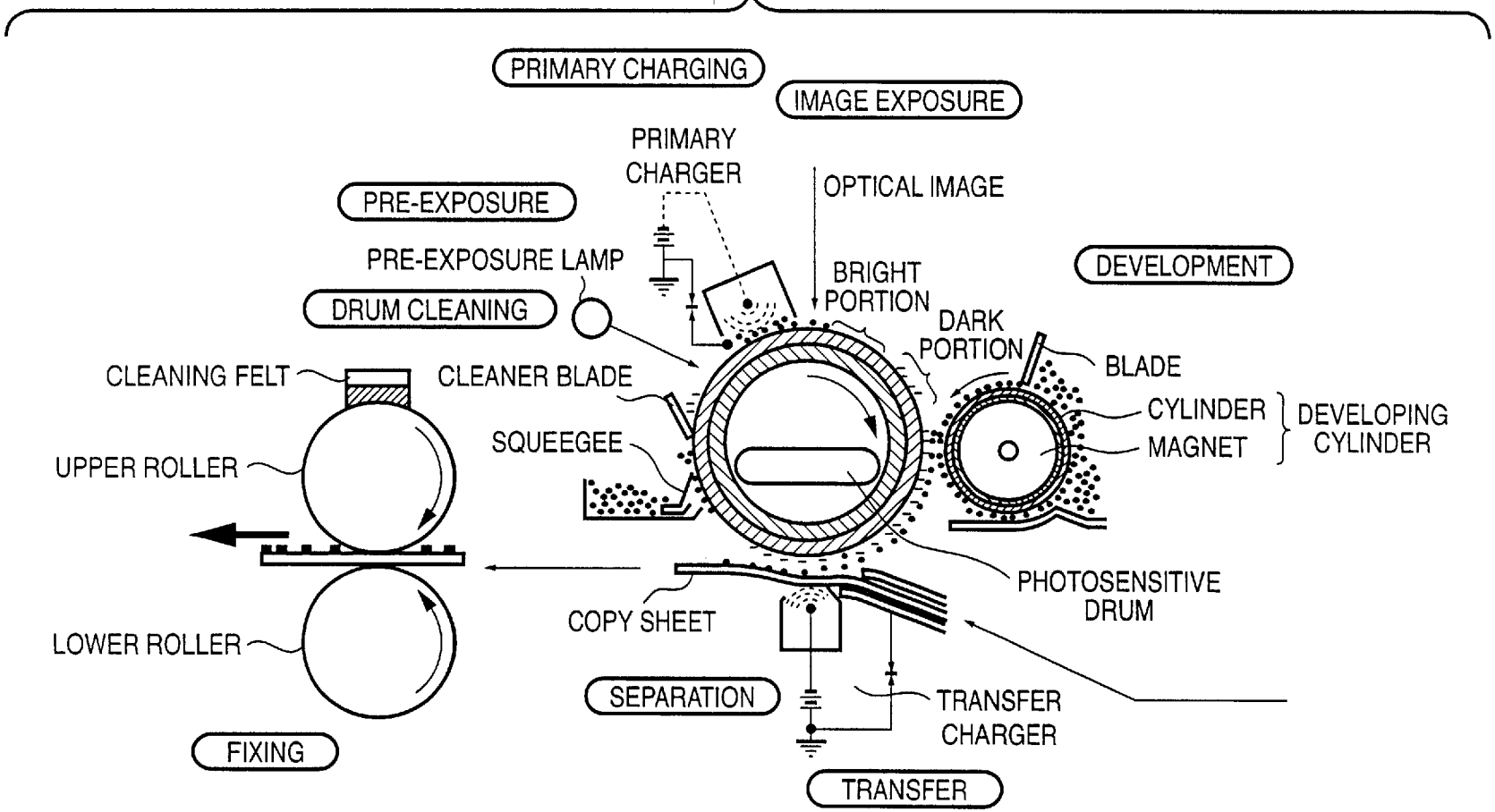
FIG. 2 is a view for explaining a cleaning target to which the present invention is applied.

FIG. 2 is a view for explaining the main part of a copying machine which is to be cleaned with the cleaning apparatus according to the present invention. The copying machine prints information such as an image or character on an image carrier such as a sheet by fixing toner as an image forming material onto it.

As shown in FIG. 2, the copying machine forms a latent image to be printed on a photosensitive drum, and transfers the latent image onto the sheet with the toner, thus forming an image.

The units of the copying machine shown in FIG. 2 are divided so they are suitable for assembly operation or overhaul operation.

When the copying machine is set in an environment where it is to be used and a copying operation is performed, the units of the respective portions in the copying machine are soiled to produce contamination in accordance with the frequency they have been used and the environment where they have been used.

The soil or contamination is caused by various factors, e.g., soil caused by the toner scattered by a toner mechanism portion incorporated in the copying machine to reach respective portions such as a developing unit, image exposure unit, transfer unit, and drum cleaning unit, soil caused by the toner when repairing the respective portions, and ambient dust attracted and attached by the static electricity of the electrical circuit units of the respective portions.

Figure 3:
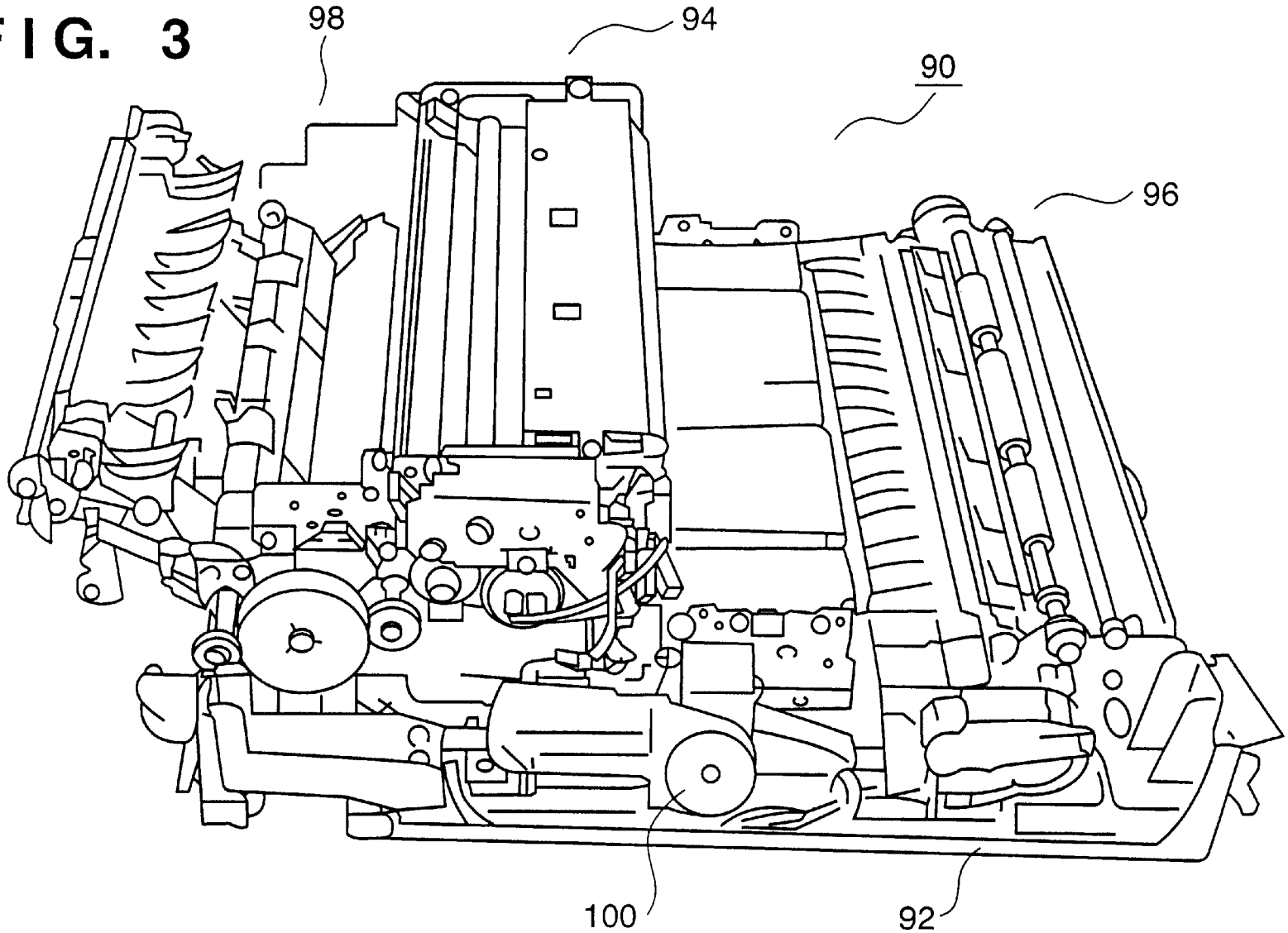
FIG. 3 is a view for explaining the arrangement of a fixing unit in a copying machine.

FIG. 3 is a perspective view of the main part of a fixing unit in the copying machine. Referring to FIG. 3, a fixing unit 90 is formed by incorporating a fixing device 94, paper feed device 96, delivery device 98, any other driving system 100, and the like in a unit housing 92. During a fixing process, toner from a toner cartridge serves as the contaminating source of the respective portions.

Figure 4:
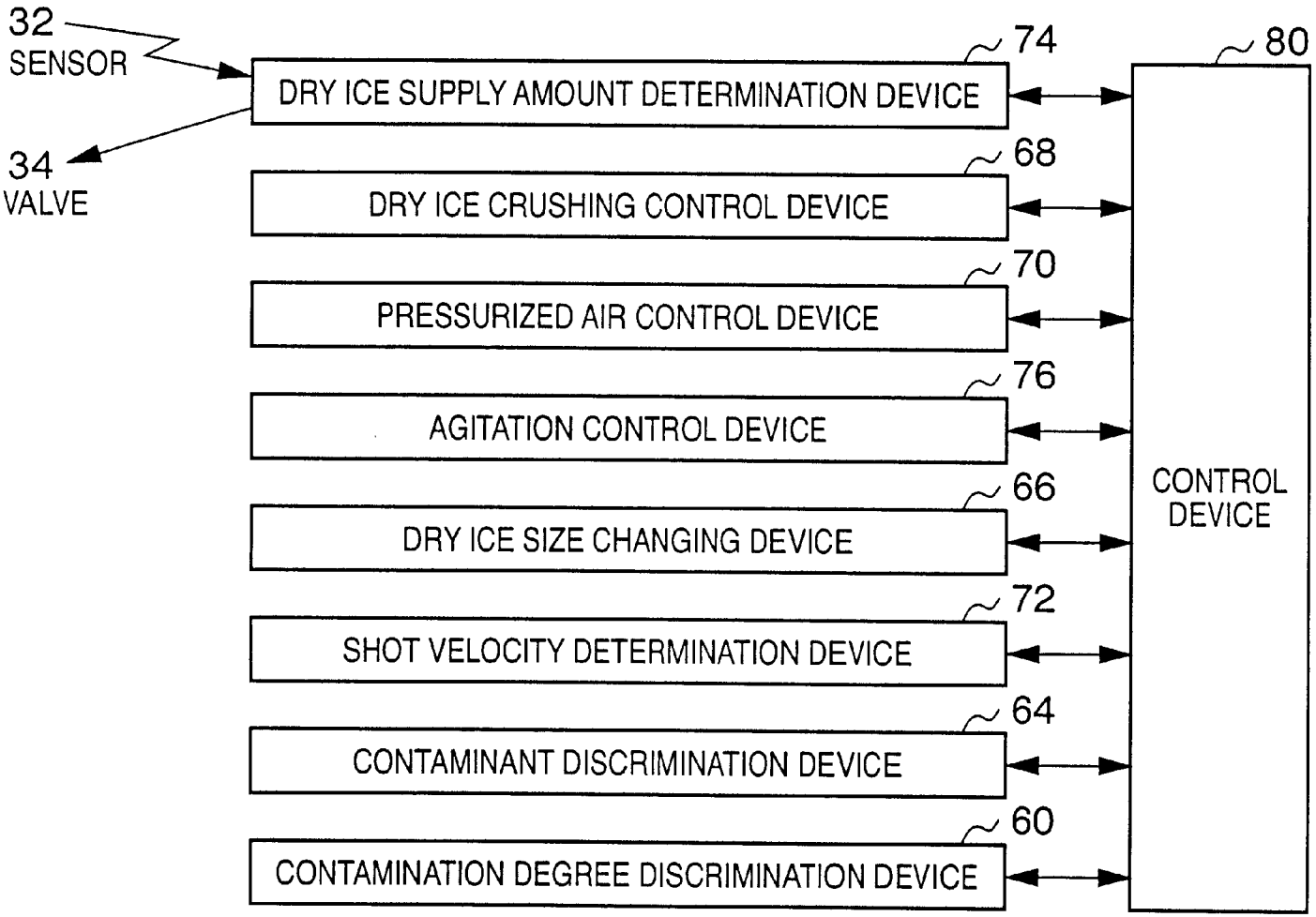
FIG. 4 is a control block diagram.

FIG. 4 is a control block diagram of the apparatus of this embodiment.

In this embodiment, the dry ice pellets have a size of 3 mm. The amount of dry ice pellets to be supplied to the hopper is 30 liters.

The rotational speed of the propellers of the first agitation device 18 was set to 5 rpm, and the rotational speed of the propeller of the second agitation device 20 was set to 9 rpm.

With the above conditions, the size of the dry ice pellets at the outlet of the hopper could be set to 3 mm to 10 mm.

The size of the dry ice pellets to be supplied to the crushing device 12 through the dry ice supply device 10 is preferably such that the dry ice pellets can be prevented from sticking to each other in the hopper because of the agitating operations of the first and second agitations devices. Also, the dry ice pellets to be supplied to the blast port of the blast nozzle through the supply pipe 14 can be kept at the predetermined size described above.

The size changing device adjusts the rotational speed of the motor of the crushing device in accordance with the types of soil and contaminants of the cleaning target, so the crushing diameter and size of dry ice to be supplied from the hopper are regulated.

When the cleaning target of this embodiment is the fixing unit 90 of the copying machine shown in FIG. 3 and the contaminant is toner, the dry ice pellets appropriately have a diameter of 0.5 mm and a length of 2 mm.

When the surface to be cleaned of the cleaning target is soiled badly and the soil cannot be removed with dry ice of a small size, the size of the dry ice is increased by adjusting (decreasing) the rotational speed of the motor of the size changing device. When the dry ice to blast the surface to be cleaned has a large size, the cleaning impact is increased, thereby adjusting the cleaning performance.

When the contaminant that soils the surface to be cleaned is other than toner, e.g., machine oil, it sticks to the surface to be cleaned. Thus, the cleaning impact must sometimes be increased.

The dry ice pellets formed by crushing with the dry ice crushing device 12 are supplied to the blast nozzle 6 through the supply pipe 14.

Pressurized air is supplied to the blast nozzle 6 from the pressurized air supply device 24 through the valve 28.

The detergent is supplied from the detergent supply device 22 through the pump 22*a*. As the detergent of this embodiment, a weak alkali detergent is used.

The amount of dry ice per unit area of the surface to be cleaned of the cleaning target was set to 0.80 g/cm$^2$ to 0.12 g/cm$^2$ per min., and the dropping amount of detergent was set to 0.15 g/sec to 0.30 g/sec.

The surface to be cleaned of a unit of the copying machine as the cleaning target placed in the cleaning booth 2 is subjected to a blast operation with the blast nozzle. When the surface to be cleaned is blasted with a mixture of pressurized air, dry ice pellets, and detergent, the soil and contamination of the surface to be cleaned can be removed.

A description will be made with reference to the control block diagram of FIG. 4.

First, the degree of soil and the contaminant of the surface to be cleaned of the cleaning target are discriminated, and information of each soil degree is input to the soil degree discrimination device 60 in accordance with the discriminated degree.

For example, levels 1, 2, 3, and 4 are determined in accordance with the degrees of cleaning difficulty.

The information from the soil degree discrimination device 60 is input to a control device 80.

The degrees of cleaning difficulty of the contaminant are determined as levels 1, 2, 3, and 4 in accordance with its level by a contaminant discrimination device 64 for each contaminant of the surface to be cleaned.

A dry ice size changing device 66 outputs a size changing signal on the basis of the information from the soil degree discrimination device 60 and contaminant discrimination device 64.

The information from the dry ice size changing device 66 is transmitted to a control device 68 of the dry ice crushing device, to control the rotational speed of the crushing blade.

The information from the dry ice size changing device 66 is also transmitted to a pressurized air control device 70. The pressurized air is controlled, so the shot velocity of the dry ice is controlled.

(Description of Operation)

The degree of soil and contaminant on the surface to be cleaned of the cleaning target is inspected to identify the contaminant. On the basis of this result, a level signal according to level discrimination is input to the contaminant discrimination device 64.

Subsequently, the degree of soil is determined, and a level signal indicating the contamination level is input to the contamination degree discrimination device 60.

Information input to the contaminant determination device 64 and contamination degree discrimination device 60 are sent to the control device 80.

The size changing control device 66 determines the size of dry ice on the basis of the information from the contaminant determination device 64 and contamination degree discrimination device 60.

A shot velocity determination device 72 determines the shot velocity of dry ice on the basis of the information from the contaminant discrimination device 64 and contamination degree discrimination device 60.

A dry ice supply amount determination device 74 determines the supply amount of dry ice on the basis of the information from the contaminant discrimination device 64, contamination degree discrimination device 60, shot velocity determination device 72, and size determination device 66.

The pressurized air control device 70 determines the shot velocity of the pressurized air on the basis of the information from the shot velocity determination device 72.

With the determination operations of the control systems described above, the size, shot velocity, and supply amount of dry ice to be blasted from the blast nozzle are determined in accordance with the degree of soil and the type of contaminant of the surface to be cleaned. Hence, the cleaning performance of the dry ice per unit area of the surface to be cleaned is specified.

The cleaning performance may be increased by blasting the detergent to the surface to be cleaned.

The cleaning performance may be adjusted by changing the blast supply amount of the detergent in accordance with the determination result of the contaminant and the determination result of the contamination degree.

As described above, according to the present embodiment, there is provided a method of cleaning a cleaning target with dry ice, wherein during a process of blasting dry ice toward a surface to be cleaned from a location where the dry ice is stored, the size of the dry ice is adjusted, so cleaning is performed while the size of the dry ice is changed in accordance with a type of soil or contaminant of the surface to be cleaned, thereby increasing a cleaning effect for each type of contaminant.

In an apparatus for cleaning a cleaning target, including an electrical component, with dry ice, the cleaning performance of dry ice can be changed in accordance with the type of soil or contaminant of the cleaning target, so the range of cleaning target can be widened.

In particular, when the cleaning performance of dry ice is adjusted in accordance with the contaminant or the degree of soil, cleaning suitable for the cleaning target can be provided. Thus, the application range of the cleaning target can be widened.

The present invention is not limited to the above embodiments and various changes and modifications can be made within the spirit and scope of the present invention. Therefore, to apprise the public of the scope of the present invention the following claims are made.

What is claimed is:

1. A method of cleaning a unit of an image forming apparatus contaminated with toner used to form an image, comprising the steps of:

supplying dry ice from dry ice storage means by way of dry ice supply means;

detecting an amount of the dry ice supplied from said dry ice supply means;

adjusting a size of the dry ice to a required size for cleaning the unit of the image forming apparatus contaminated with toner after said detecting step;

supplying the dry ice to a nozzle, wherein the nozzle communicates with the dry ice supply means;

cleaning the unit of the image forming apparatus by blasting the dry ice, with pressurized air from the nozzle to the toner present on the unit of the image forming apparatus, wherein the blasting removes the toner from the unit of the image forming apparatus; and recovering the dry ice after said cleaning step.

2. The method according to claim 1, further comprising the step of adding a surfactant to the dry ice.

3. A method of cleaning a unit of an image forming apparatus contaminated with toner used to form an image, comprising the steps of:

supplying dry ice from ice storage means by way of dry ice supply means;

determining the level of contamination and type of soil present on the unit of the image forming apparatus;

detecting an amount of the dry ice supplied from the dry ice supply means;

adjusting a size of the dry ice to a required size for cleaning the unit of the image forming apparatus contaminated with toner, wherein the size of the dry ice is adjusted depending on the level of contamination and the type of soil present on the image forming apparatus;

supplying the dry ice to a nozzle, wherein the nozzle communicates with the dry ice supply means; and cleaning the unit of the image forming apparatus by blasting the dry ice with pressurized air from the nozzle to the toner present on the unit of the image forming apparatus, wherein the blasting removes the toner from the unit of the image forming apparatus.

* * * * *